US011109125B2

(12) United States Patent
Kutil et al.

(10) Patent No.: US 11,109,125 B2
(45) **Date of Patent: *Aug. 31, 2021**

(54) CURVABLE LINE ARRAY

(71) Applicant: Bose Corporation, Framingham, MA (US)

(72) Inventors: Joseph J. Kutil, Franklin, MA (US); Paul F. Fidlin, Wayland, MA (US); Peter C. Santoro, Groton, MA (US); Robert A. Warden, Southborough, MA (US); Kenneth D. Jacob, Framingham, MA (US)

(73) Assignee: Bose Corporation, Framingham, MA (US)

( * ) Notice: Subject to any disclaimer, the term of this patent is extended or adjusted under 35 U.S.C. 154(b) by 137 days.

This patent is subject to a terminal disclaimer.

(21) Appl. No.: 16/400,081

(22) Filed: May 1, 2019

(65) Prior Publication Data

US 2019/0261073 A1 Aug. 22, 2019

Related U.S. Application Data

(63) Continuation of application No. 16/113,308, filed on Aug. 27, 2018, now Pat. No. 10,327,051, which is a continuation of application No. 15/899,002, filed on Feb. 19, 2018, now Pat. No. 10,063,948, which is a continuation of application No. 14/246,388, filed on Apr. 7, 2014, now abandoned.

(51) Int. Cl.

| | |
|---|---|
| ***H04R 1/02*** | (2006.01) |
| ***H04R 1/00*** | (2006.01) |
| ***H04R 1/40*** | (2006.01) |
| *H04R 27/00* | (2006.01) |

(52) U.S. Cl.

CPC ..... *H04R 1/00* (2013.01); *H04R 1/403* (2013.01); *H04R 1/023* (2013.01); *H04R 1/025* (2013.01); *H04R 27/00* (2013.01); *H04R 2201/025* (2013.01); *H04R 2201/403* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,758,852 A * | 6/1998 | Martin | H04R 1/026 | 248/282.1 |
| 6,009,182 A * | 12/1999 | Gunness | H04R 1/345 | 381/182 |
| 2003/0053644 A1* | 3/2003 | Vandersteen | H04R 1/26 | 381/182 |
| 2005/0201583 A1* | 9/2005 | Colich | H04R 1/403 | 381/335 |

* cited by examiner

*Primary Examiner* — Amir H Etesam

(74) *Attorney, Agent, or Firm* — Bose Corporation

(57) ABSTRACT

A line array loudspeaker includes a first plurality of flexible joints, a first plurality of electro-acoustic drivers being linked to each other by the first plurality of flexible joints, and a first sectional horn assembly coupled to the first plurality of electro-acoustic drivers. The first plurality of electro-acoustic drivers is adjustable so that it can be positioned such that an axis that runs through an acoustic center of the first plurality of electro-acoustic drivers is articulable to produce three or more configurations including: a substantially straight configuration and a plurality of arcuate configurations.

19 Claims, 17 Drawing Sheets

CURVABLE LINE ARRAY

CROSS REFERENCE TO RELATED APPLICATIONS

This application is a continuation of U.S. patent application Ser. No. 16/113,308 filed on Aug. 27, 2018, which is a continuation of U.S. patent application Ser. No. 15/899,002 filed on Feb. 19, 2018, now U.S. Pat. No. 10,063,948, which is a continuation of U.S. patent application Ser. No. 14/246,388 filed on Apr. 7, 2014 in the name Kutil et al.

BACKGROUND

This disclosure relates to line array loudspeakers.

Various devices have been used to control sound dispersion from loudspeaker systems. One method is to use multiple loudspeaker drivers arranged in a line source or array. A typical line array loudspeaker system includes a plurality of loudspeaker drivers arranged in a line in one or more enclosures. A line array system in which the drivers are oriented in a straight line may produce a directivity response that is too narrow vertically for some venues. For example, in venues where listeners are situated on multiple horizontal planes, a line array system in which the drivers are oriented in a straight line may have a directivity pattern that reaches only some of the audience. Thus, depending on a listener's location in a venue, intelligibility and listening ease may suffer.

SUMMARY

In general, in some aspects, a loudspeaker system includes a first flexible panel, a first line array of electro-acoustic drivers, and at least one mechanically adjustable point. The first line array of electro-acoustic drivers are mounted on the first flexible panel and linked to each other by flexible joints in the first flexible panel. The at least one mechanically adjustable point enables articulation of the first flexible panel at the flexible joints to produce one or more of a substantially straight and an arcuate configuration of the first line array of electro-acoustic drivers.

Implementations may include any, all or none of the following features. The first flexible panel may be coupled to a first sectional horn that curves in conjunction with the first line array of electro-acoustic drivers when positioned in an arcuate configuration. The first sectional horn and first flexible panel may be produced as a single-piece injection molded part. The first sectional horn and first flexible panel may comprise a flexible material.

The first line array of electro-acoustic drivers may be disposed in a first housing.

The arcuate configuration may be selected from one of: a J-shaped configuration, a reverse J-shaped configuration, and a C-shaped configuration.

The loudspeaker system may further include a second line array of electro-acoustic drivers mounted on a second flexible panel, each of the electro-acoustic drivers of the second line array linked to each other by flexible joints in the second flexible panel. The loudspeaker system may further include at least one mechanically adjustable point that enables articulation of the second flexible panel at the flexible joints. The second line array of electro-acoustic drivers may be disposed in the first housing and positioned in a manner that extends the first line array of electro-acoustic drivers, so that the height of the loudspeaker system is increased and the width of the loudspeaker system remains substantially the same. The first and second flexible panels may be adjustable so that the first and second line array of electro-acoustic drivers together form one of: a substantially straight line, a J-shape, a reverse J-shape, and a C-shape.

The first line array of electro-acoustic drivers may be positioned in front of a low frequency driver.

The loudspeaker system may further include a handle coupled to the at least one mechanically adjustable point to enable manual adjustment of the first flexible panel.

One or more magnets may secure the at least one mechanically adjustable point into the substantially straight or arcuate configuration.

The loudspeaker system may further include a protective grille positioned in front of the first line array of electro-acoustic drivers. The protective grille may curve in conjunction with the first line array of electro-acoustic drivers when positioned in an arcuate configuration.

The loudspeaker system may further include a second line array of electro-acoustic drivers mounted on a second flexible panel, each of the electro-acoustic drivers of the second line array linked to each other by flexible joints in the second flexible panel. The loudspeaker system may further include at least one mechanically adjustable point that enables articulation of the second flexible panel at the flexible joints. The second line array of electro-acoustic drivers may be disposed in a second housing that is configured to be positioned in a manner that extends the first housing, so that the height of the loudspeaker system is increased and the width of the loudspeaker system remains substantially the same. The first and second flexible panels may be adjustable so that the first and second line array of electro-acoustic drivers together form a substantially straight line, a J-shape, a reverse J-shape, or a C-shape.

The at least one mechanically adjustable point may be positioned substantially at the center of the flexible panel. The at least one mechanically adjustable point may be positioned at an end of the flexible panel.

The flexible joints in the first flexible panel may comprise flexible hinges.

In general, in some aspects, a method includes providing a line array of electro-acoustic drivers mounted on a flexible panel, each of the drivers of the line array being linked to each other by flexible joints in the flexible panel. The method further includes providing a mounting bracket configured to be attached to the flexible panel. The method further includes determining that the line array of electro-acoustic drivers has been configured to be one of a substantially straight and an arcuate configuration.

Implementations may include any, all or none of the following features. The flexible panel may be coupled to a sectional horn that curves in conjunction with the line array of electro-acoustic drivers when positioned in an arcuate configuration. The sectional horn and flexible panel may be produced as a single-piece injection molded part.

The arcuate configuration may be selected from at least one of: a J-shaped configuration, a reverse J-shaped configuration, and a C-shaped configuration.

The method may further include providing a protective grille in front of the line array of electro-acoustic drivers. The protective grille may curve in conjunction with the line array of electro-acoustic drivers when positioned in an arcuate configuration.

In general, in some aspects, a line array loudspeaker includes a first enclosure that has a first flexible panel, a first plurality of electro-acoustic drivers, and a first sectional horn assembly. The first plurality of electro-acoustic drivers are coupled to the first flexible panel. The first sectional horn assembly is coupled to the first flexible panel. The first flexible panel is adjustable so that it can be positioned such that an axis that runs through an acoustic center of the electro-acoustic drivers is configured to be one of: a substantially straight configuration and an arcuate configuration.

Implementations may include any, all or none of the following features. The arcuate configuration may be selected from at least one of a J-shaped configuration, a reverse J-shaped configuration, and a C-shaped configuration.

The first sectional horn assembly may be flexible, such that it curves in conjunction with the first flexible panel when positioned in an arcuate configuration. The first sectional horn assembly and first flexible panel may be produced as a single-piece injected molded part.

The line array loudspeaker may further include a second flexible panel, a second plurality of electro-acoustic drivers, and a second sectional horn assembly. The second plurality of electro-acoustic drivers may be coupled to the second flexible panel. The second sectional horn assembly may be coupled to the second flexible panel. The second plurality of electro-acoustic drivers may be disposed in the first housing and positioned in a manner that extends the first plurality of electro-acoustic drivers, so that the height of the line array loudspeaker is increased and the width of the line array loudspeaker remains substantially the same. The first and second flexible panels may be adjustable so that they together form one of: a substantially straight line, a J-shape, a reverse J-shape, and a C-shape.

The line array loudspeaker may further include a handle coupled to the first flexible panel to enable manual adjustment of the first flexible panel.

One or more magnets may secure the first flexible panel into one of: a substantially straight line, J-shape, reverse J-shape, and C-shape.

The line array loudspeaker may further include a protective grille positioned in front of the first plurality of electro-acoustic drivers. The protective grille may be flexible, such that it curves in conjunction with the first flexible panel when positioned in an arcuate configuration.

The line array loudspeaker may further include a second enclosure that has a second flexible panel, a second plurality of electro-acoustic drivers, and a second sectional horn assembly. The second plurality of electro-acoustic drivers may be coupled to the second flexible panel. The second sectional horn assembly may be coupled to the second flexible panel. The second enclosure may be configured to be positioned in a manner that extends the first enclosure, so that the height of the line array loudspeaker is increased and the width of the line array loudspeaker remains substantially the same. The first and second flexible panels may be adjustable so that they together form one of: a substantially straight line, a J-shape, a reverse J-shape, and a C-shape.

Implementations may include one of the above and/or below features, or any combination thereof. Other features and advantages will be apparent from the description and the claims.

BRIEF DESCRIPTION OF THE DRAWINGS

For purposes of illustration some elements are omitted and some dimensions are exaggerated.

DETAILED DESCRIPTION

Figure 1:
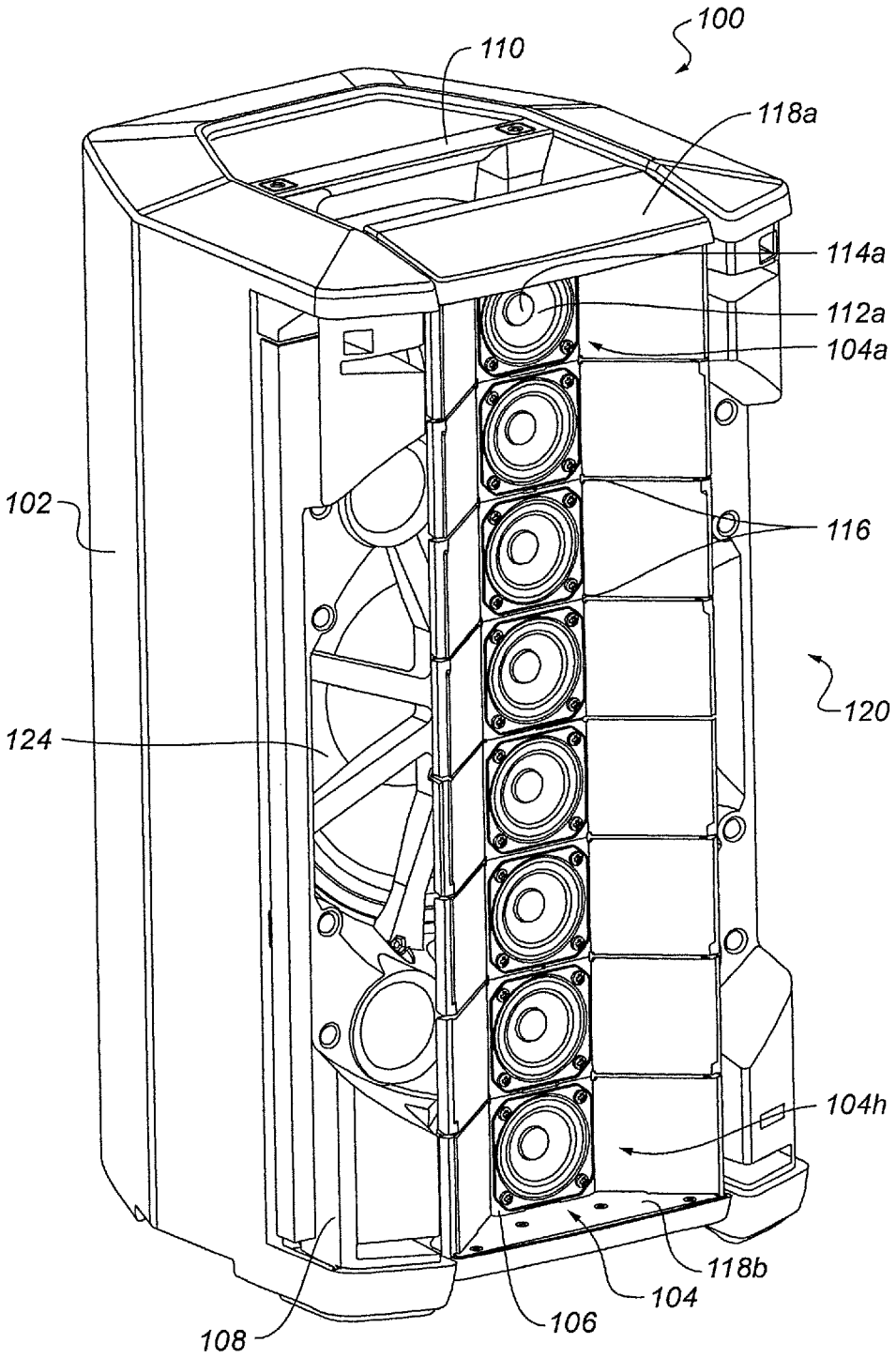
FIG. 1 is a perspective view of an adjustable line array loudspeaker.

Referring to FIG. 1, a line array loudspeaker 100 includes a housing 102 (also referred to as an enclosure or cabinet) and a plurality of electro-acoustic drivers 104 coupled to a flexible panel 106, which is coupled to a mounting bracket 108 within the housing 102. The housing 102 may have a handle 110 to permit carrying during transport. Each electro-acoustic driver 104 typically includes a motor structure (not shown) mechanically coupled to a radiating component, such as a diaphragm, cone, dome, or other surface (for example, cone 112*a* on driver 104*a* in FIG. 1). Attached to the inner edge of the cone may be a dust cover or dust cap, which also may be dome-shaped (for example, dust cap 114*a* on driver 104*a* in FIG. 1). In operation, the motor structure operates as a linear motor, causing the radiating surface to vibrate along an axis of motion. This movement causes changes in air pressure, which results in the production of sound. The electro-acoustic drivers 104 may be mid-high or high frequency drivers, typically having an operating range of approximately 200 Hz to 16 kHz. In other applications, the electro-acoustic drivers 104 in the line array loudspeaker 100 may be of numerous types, including but not limited to compression drivers, cone drivers, mid-range drivers, full-range drivers, and tweeters. Although eight electro-acoustic drivers 104*a*-104*h* are shown in FIG. 1, any number of drivers could be used.

The electro-acoustic drivers 104*a*-104*h* may be joined by flexible joints 116 (two of which are referenced in FIG. 1) in the flexible panel 106. The flexible joints may function as a living hinge, and 116 enable curving of the flexible panel 106 into a number of configurations. As described herein, the flexible joints 116 may have varying levels of stiffness depending on their position on the flexible panel 106. The stiffness of the flexible joints 116 could be varied by, for example, using a different material, geometry, or thickness, or any combination thereof. Although in the example shown in FIG. 1 each driver 104 is separated from an adjacent driver by a flexible joint 116, in some examples, multiple drivers may be positioned between the flexible joints 116. One or more mechanically adjustable points may be positioned at opposite ends of the flexible panel 106 or along the interior of the flexible panel to enable articulation of the flexible panel 106 and electro-acoustic drivers 104 to produce any one of several configurations for the line array loudspeaker 100.

In some examples, one or more mechanically adjustable points are provided at opposite ends of the flexible panel 106, while the center of the flexible panel 106 is fixed. For example, as shown in FIG. 1, adjustment handles 118*a* and 118*b* may be positioned at opposite ends of the flexible panel 106 to enable articulation of the flexible panel 106, and therefore the electro-acoustic drivers 104. The flexible panel 106 and electro-acoustic drivers 104 can be positioned via the adjustment handles 118*a*, 118*b* to be in a substantially straight configuration (as shown in FIG. 1) such that an axis that runs through the acoustic centers of the drivers 104 is a substantially straight line. The acoustic centers of the drivers 104 may be approximately at each driver's dust cap 114. Alternatively, the flexible panel 106 and electro-acoustic drivers 104 can be positioned via the adjustment handles 118*a*, 118*b* to be in an arcuate configuration, as will be further described. In an arcuate configuration, an axis that runs through the acoustic centers of the drivers 104 is curved, and could take on a number of shapes having a curved cross section when viewed from the side, including, for example, a J-shape, reverse J-shape, C-shape, and S-shape. Other mechanisms could be used to adjust the flexible panel 106 at each end, including but not limited to a fastener (e.g., a screw, clamp, clasp, clip, pin or rivet) and an adjustment rod.

Figure 3:
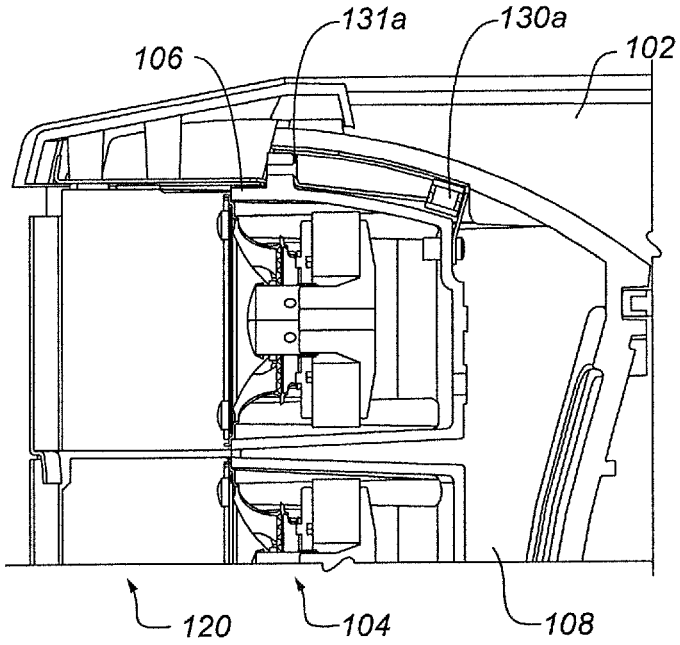
FIG. 3 is partial side sectional view of the adjustable line array loudspeaker of FIG. 1.

In some examples, the line array loudspeaker 100 includes a sectional horn assembly 120 (also referred to as a director), which includes a plurality of horn walls 122 (see FIG. 3) that may be mechanically and/or acoustically coupled to the electro-acoustic drivers 104 via the flexible panel 106. In operation, the horn walls 122 aid in conducting the sound waves to the external environment, and control the horizontal dispersion of the sound waves. In some examples, the sectional horn assembly 120 is configured to curve in conjunction with the flexible panel 106. In other examples, however, the sectional horn assembly 120 is fixed in place within the housing 102, even when the line array loudspeaker 100 is in an arcuate configuration.

In some examples (see FIGS. 3 and 4), the line array loudspeaker 100 does not include a sectional horn assembly 120, so the electro-acoustic drivers 104 are mounted on a flexible panel 106 without any horn walls 122. In examples where the line array loudspeaker 100 does not include horn walls 122, the flexible panel 106 may have one or more sides comprising an acoustically transparent material such as cloth or mesh, to transmit additional sound waves generated by the electro-acoustic drivers 104 to the external environment when the line array is in an arcuate configuration.

The line array loudspeaker 100 may be configured to operate with a bass module (also referred to as a subwoofer or low frequency driver). In some examples, a low frequency driver 124 is disposed within the housing 102 of the line array loudspeaker 100, behind the plurality of electro-acoustic drivers 104. The mounting bracket 108 may have a bass port with a series of baffles in the center or other portion of the bracket for housing the low frequency driver 124. The low frequency driver 124 may have an operating range of approximately 50 Hz to 200 Hz. Alternatively, one or more bass modules may be provided external to the line array loudspeaker 100.

Referring to FIGS. 2A through 2D, to adjust the position of the flexible panel 106 and electro-acoustic drivers 104, a user manually moves one or both of the adjustment handles 118*a*, 118*b*. Moving one or both of the adjustment handles 118*a*, 118*b* causes the flexible joints 116 in the flexible panel 106 to flex or bend, which in turn causes the flexible panel 106 to flex or bend in a manner corresponding to the movement of the adjustment handles 118*a* and/or 118*b*. As a result, the position of flexible panel 106 and electro-acoustic drivers 104 can be altered to create various configurations, including, for example, a substantially straight configuration, a J-shaped configuration, a reverse J-shaped configuration, a C-shaped configuration, and an S-shaped configuration. While FIGS. 2A through 2D illustrate adjustment points provided at opposite ends of the flexible panel, it should be understood that the line array loudspeaker could be curved via adjustment points provided on the flexible panel in between the ends of the flexible panel, as will be further described.

Figure 2A:
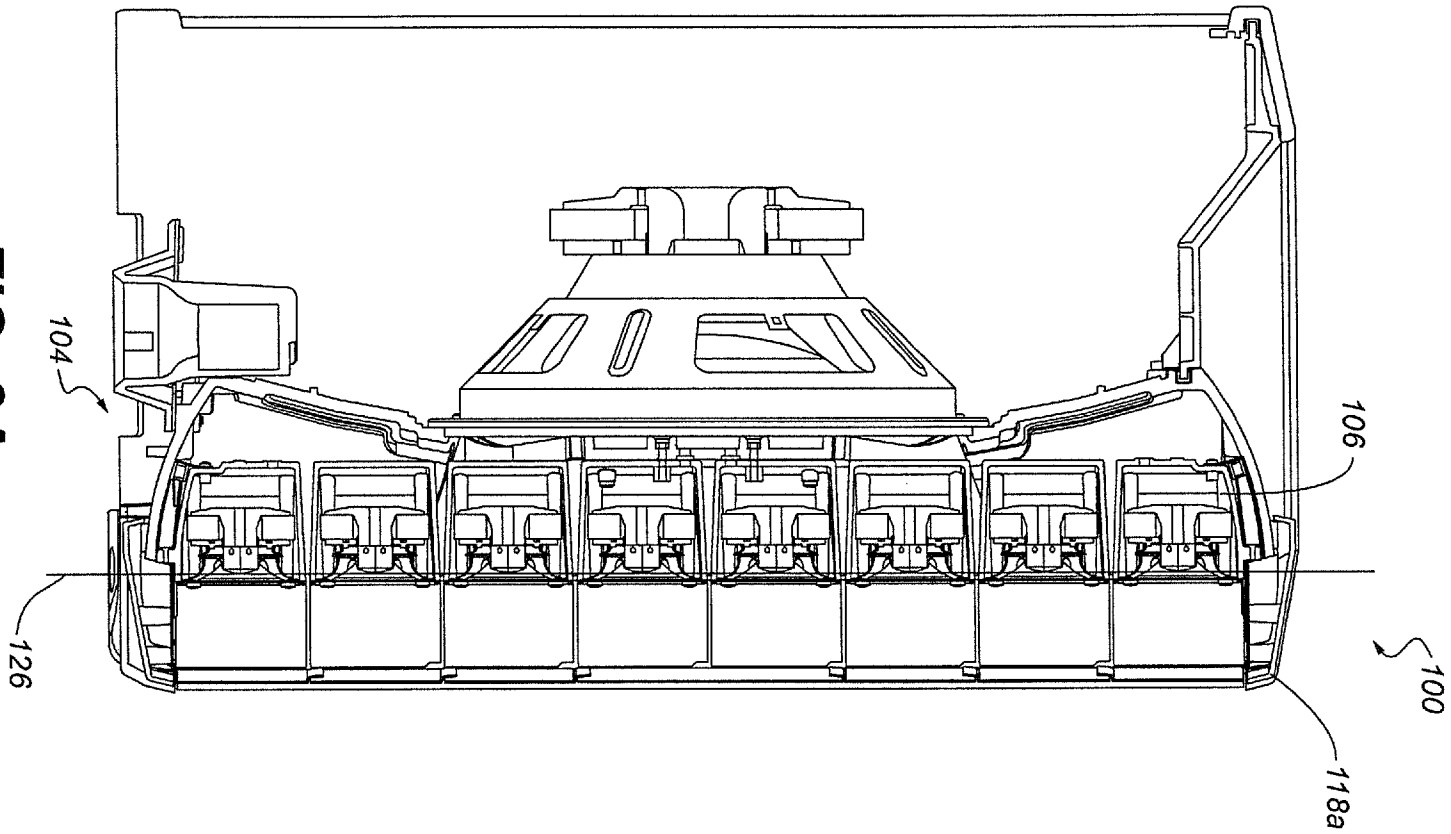
FIG. 2A is a side sectional view of the loudspeaker of FIG. 1 with the line array configured in a substantially straight line.

FIG. 2A shows a side view of the line array loudspeaker 100 when both adjustment handles 118*a*, 118*b* are positioned so that the flexible panel 106 and electro-acoustic drivers 104 are in a substantially straight line. In this configuration, the adjustment handles 118*a*, 118*b* remain in a neutral position, so there is little to no bending or flexing applied to the flexible panel 106. As shown in FIG. 2A, an axis 126 that runs through the acoustic centers of the drivers 104 (approximately at each driver's dust cap) is a substantially straight line. This substantially straight configuration provides tight vertical control and high sound pressure level (SPL) and may be suitable when an audience is situated on a single plane, for example at live music performance venues.

Figure 2B:
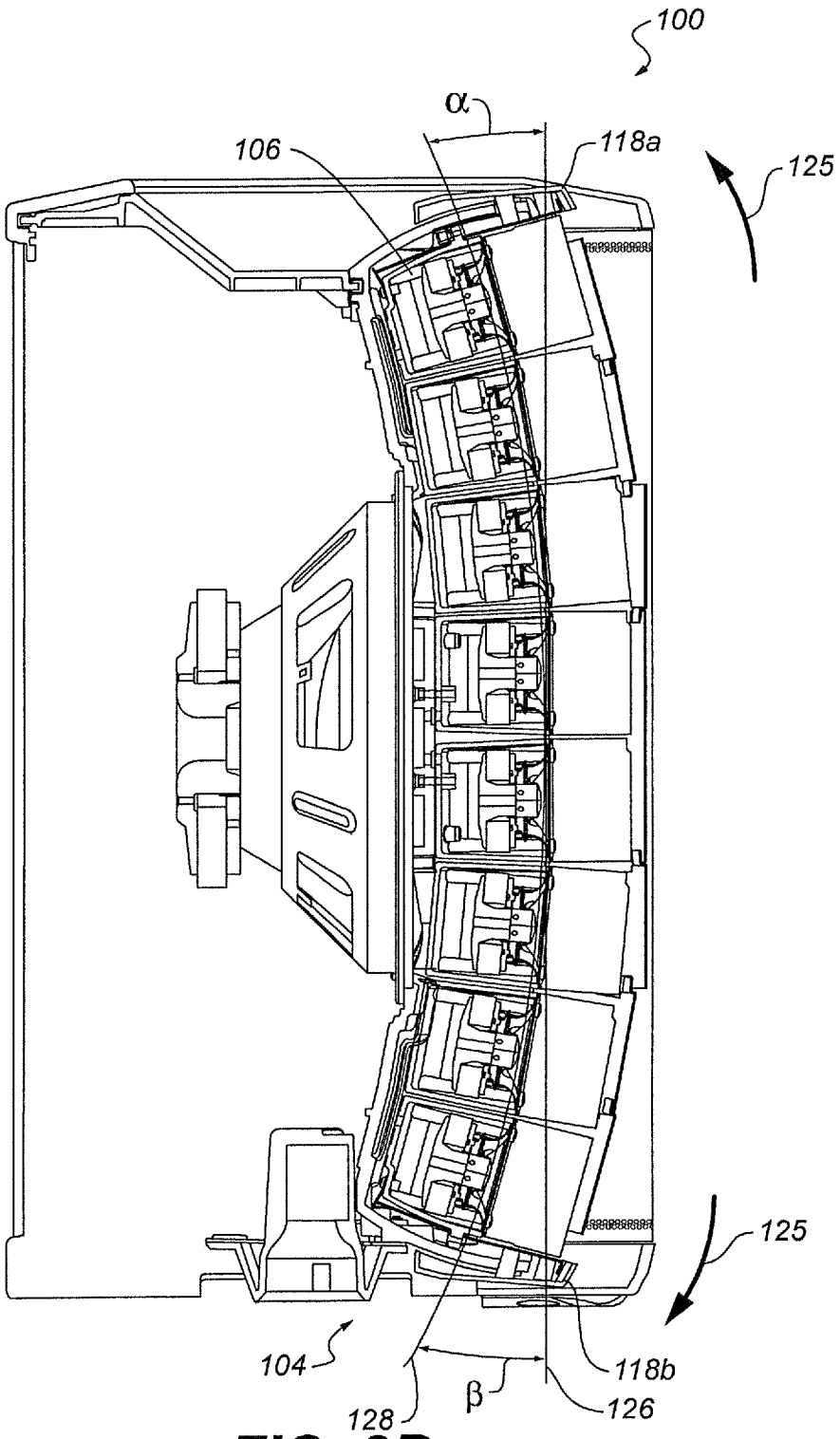
FIG. 2B is a side sectional view of the loudspeaker of FIG. 1 with the line array configured in a C-shape.

FIG. 2B shows a side view of the line array loudspeaker 100 when both adjustment handles 118*a*, 118*b* have been moved away from the front plane of the line array loudspeaker 100, in a direction indicated by the arrows 125 in FIG. 2B. By moving both adjustment handles 118*a* and 118*b*, the flexible panel 106 and electro-acoustic drivers 104 curve in a manner that corresponds to the movement of the adjustment handles 118*a*, 118*b*, creating a C-shaped curve. As shown in FIG. 2B, an axis 128 that runs through the acoustic centers of the drivers 104 (approximately at each driver's dust cap) is curved in a C-shape that is convex when viewed from the front of the line array loudspeaker 100. In other examples, the adjustment handles 118*a* and 118*b* could be moved in the opposite direction, toward the front plane of the line array loudspeaker 100, so the C-shape is concave when viewed from the front of the loudspeaker.

As shown in FIG. 2B, the top and bottom of the flexible panel 106 curve at an angle from an axis 126 corresponding to the acoustic centers of the drivers 104 when positioned in the substantially straight configuration of FIG. 2A. Those angles are represented in FIG. 2B as $\alpha$ and $\beta$ for the top and bottom of the flexible panel 106, respectively. In some examples, the adjustment handles 118*a*, 118*b* may be moved to the same relative position, so that the resulting curvature at opposite ends of the flexible panel 106 is the same. In this example, angles $\alpha$ and $\beta$ would be approximately equal. In other examples, the adjustment handles 118*a*, 118*b* may be moved to different relative positions, so that the resulting curvature at opposite ends of the flexible panel 106 is different. In this example, angles α and β would be different. Angles α and β can range from −45 degrees to 45 degrees. This C-shaped configuration increases the vertical dispersion of the line array loudspeaker 100 at both ends of the loudspeaker, and may be suitable for venues in which the floor has extreme "raked" seating (i.e., the floor is not a single horizontal plane, but rather is an inclined plane or a series of multiple horizontal stepped planes or tiers).

Figure 2C:
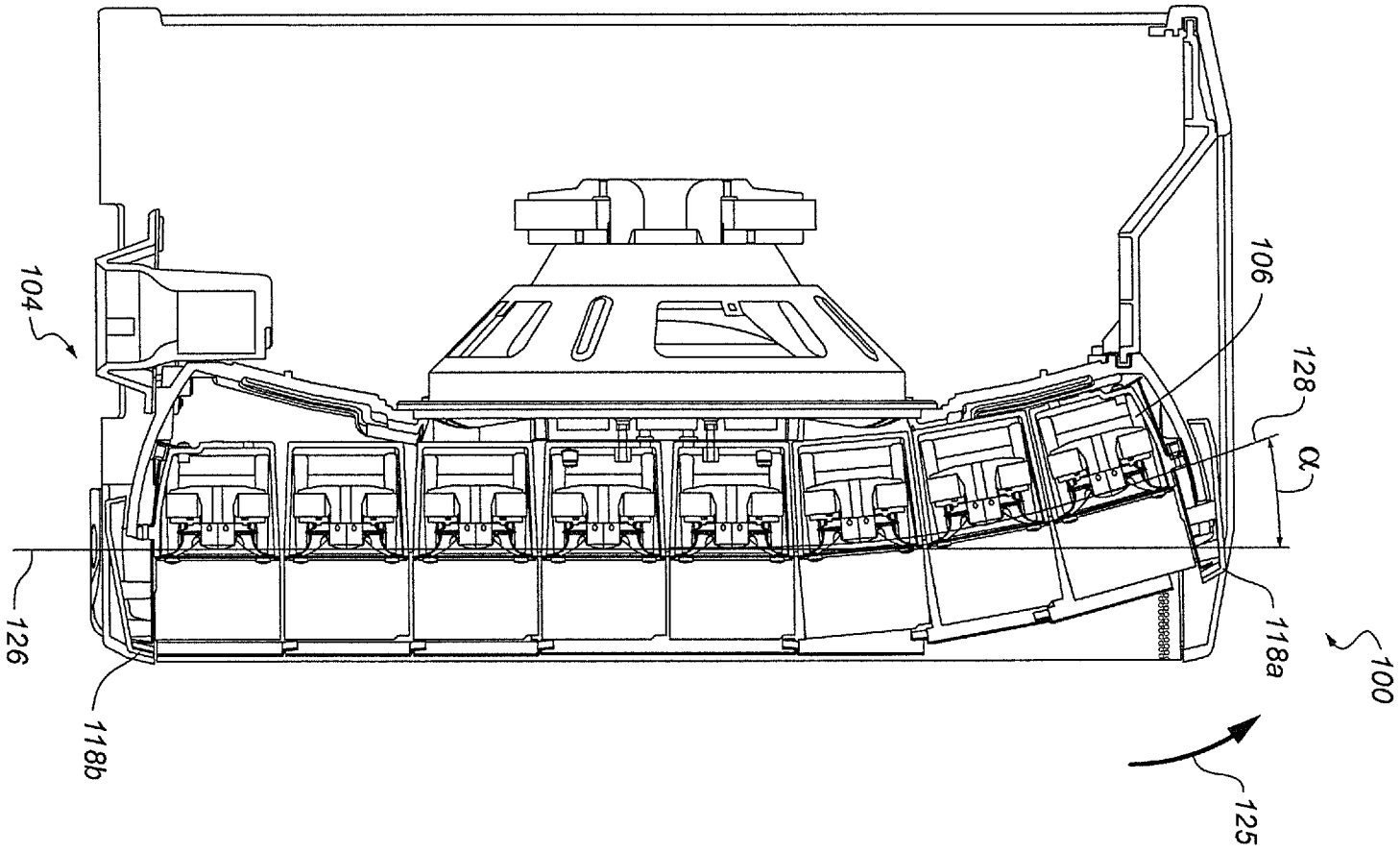
FIG. 2C is a side sectional view of the loudspeaker of FIG. 1 with the line array configured in a reverse J-shape.

FIG. 2C shows a side view of the line array loudspeaker 100 when adjustment handle 118*a* has been moved away from the front plane of the line array loudspeaker 100, in a direction indicated by the arrow 125 in FIG. 2C, while adjustment handle 118*b* remains in a neutral position. By moving only adjustment handle 118*a*, the flexible panel 106 and electro-acoustic drivers 104 curve in a manner that corresponds to the movement of the adjustment handle 118*a*, creating a reverse J-shaped curve. As shown in FIG. 2C, an axis 128 that runs through the acoustic centers of the drivers 104 (approximately at each driver's dust cap) is curved in a reverse J-shape, where the top of the flexible panel 106 curves away from the front plane of the line array loudspeaker 100. In other examples, the adjustment handle 118*a* may be moved in the opposite direction, toward the front plane of the line array loudspeaker 100, so the top of the flexible panel 106 curves toward the front plane of the line array loudspeaker 100. As shown in FIG. 2C, the top of the flexible panel 106 curves at an angle α from an axis 126 corresponding to the acoustic centers of the drivers 104 when positioned in the substantially straight configuration of FIG. 2A. As with FIG. 2B, angle α can range from −45 degrees to 45 degrees. This reverse J-shaped configuration increases the vertical dispersion of the line array loudspeaker 100 at the top of the loudspeaker, and may be suitable for venues having balconies or other seating that is located above the main floor.

Figure 2D:
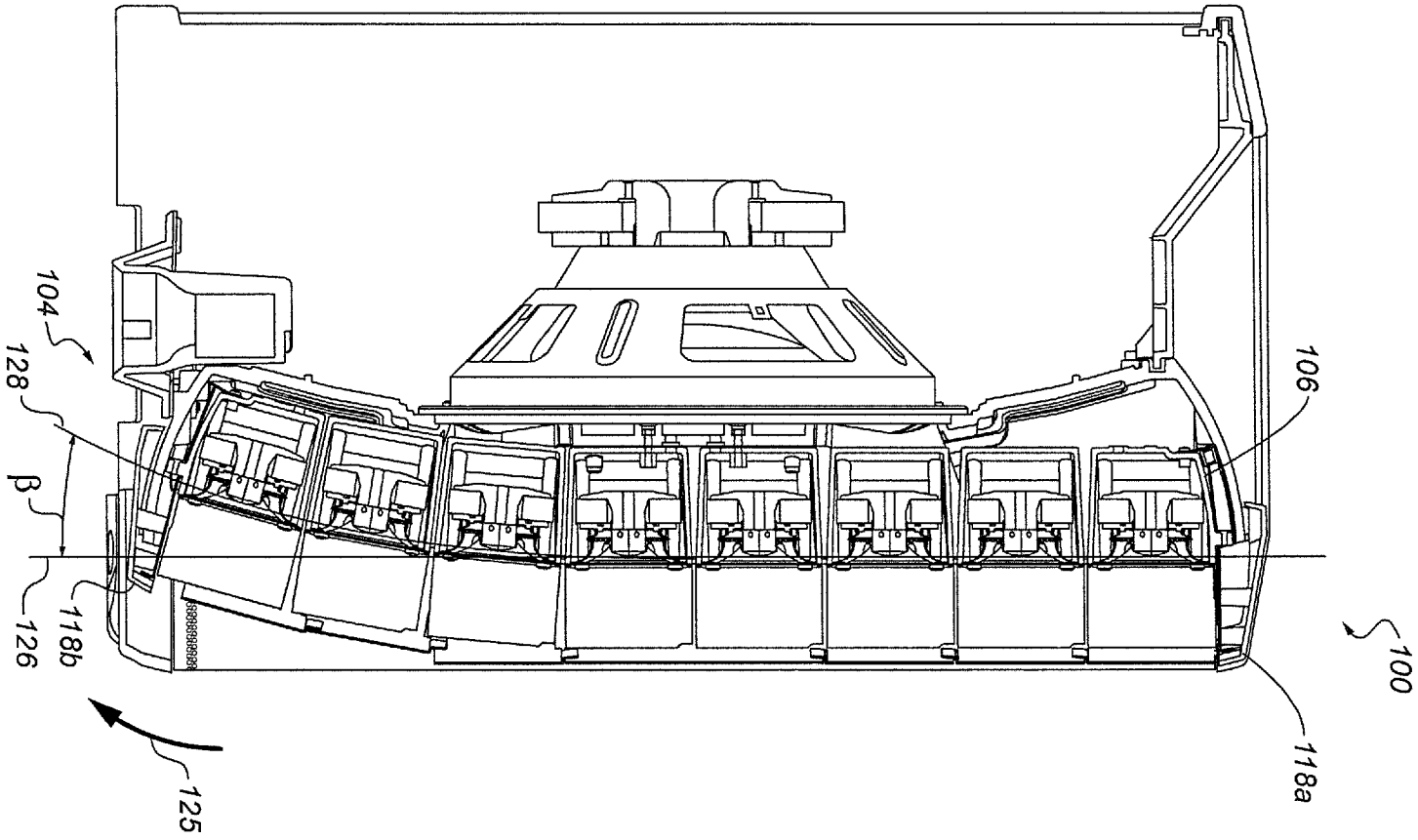
FIG. 2D is a side sectional view of the loudspeaker of FIG. 1 with the line array configured in a J-shape.

FIG. 2D shows a side view of the line array loudspeaker 100 when adjustment handle 118*b* has been moved away from the front plane of the line array loudspeaker 100, in a direction indicated by the arrow 125 in FIG. 2D, while adjustment handle 118*a* remains in a neutral position. By moving only adjustment handle 118*b*, the flexible panel 106 and electro-acoustic drivers 104 curve in a manner that corresponds to the movement of the adjustment handle 118*b*, creating a J-shaped curve. As shown in FIG. 2D, an axis 128 that runs through the acoustic centers of the drivers 104 (approximately at each driver's dust cap) is curved in a J-shape, where the bottom of the flexible panel 106 curves away from the front plane of the line array loudspeaker 100. In other examples, the adjustment handle 118*b* may be moved in the opposite direction, toward the front plane of the line array loudspeaker 100, so the bottom of the flexible panel 106 curves toward the front plane of the line array loudspeaker 100. As shown in FIG. 2D, the bottom of the flexible panel 106 curves at an angle β from an axis 126 corresponding to the acoustic centers of the drivers 104 when positioned in the substantially straight configuration of FIG. 2A. As with FIG. 2B, angle β can range from −45 degrees to 45 degrees. This J-shaped configuration increases the vertical dispersion of the line array loudspeaker 100 at the bottom of the loudspeaker, and may be suitable for venues having inclined or raked seating.

In some examples, the flexible panel 106 can be adjustable from the substantially straight configuration to a single position at each end of the flexible panel 106. For example, angles α and β could be configured to be 15 degrees, so that each adjustment handle 118*a* and 118*b* could be moved to position the flexible panel 106 in a manner that curves the top and bottom of the panel 15 degrees from an axis 126 corresponding to the acoustic centers of the drivers 104 when positioned in a substantially straight configuration. Alternatively, the flexible panel 106 could be adjustable from the substantially straight configuration to multiple positions at each end of the flexible panel. In some examples, stop points could be provided at certain intervals, for example every 5 degrees, to enable multiple adjustment points. For example, angles α and β could be configured to be 5, 10 or 15 degrees, so that each adjustment handle 118*a* and 118*b* could be moved to position the flexible panel 106 in a manner that curves the top and bottom of the panel at 5, 10 or 15 degrees from an axis 126 corresponding to the acoustic centers of the drivers 104 when positioned in a substantially straight configuration. Any number of adjustment angles having any number of values could be provided.

The electro-acoustic drivers 104 may be positioned on the flexible panel 106 so that when the flexible panel 106 is in an arcuate configuration, the angular offset between each acoustic driver is the same. For example, for a flexible panel 106 having four electro-acoustic drivers 104*a*-104*d*, if the flexible panel can be curved to be 15 degrees from an axis 126 corresponding to the acoustic centers of the drivers 104 when positioned in a substantially straight configuration, the electro-acoustic drivers 104*a*-104*d* could be positioned on the flexible panel 106 to have 5 degrees between the axis of each adjacent acoustic driver when the flexible panel 106 is curved. To accomplish this, the flexible joints 116 on the flexible panel 106 may have varying levels of stiffness depending on their position on the flexible panel. For example, flexible joints 116*a* and 116*b* (FIG. 4) may permit more bending or flexing than flexible joint 116*c* to make the angular offset between each driver the same. The stiffness of the flexible joints 116 could be varied by, for example, using a different material, geometry, or thickness, or any combination thereof, for each flexible joint 116. In other examples, the angular offset between each acoustic driver 104 when the flexible panel 106 is in an arcuate configuration could vary.

In some examples, the flexible panel 106 may be secured into a position via one or more magnets. For example, referring to FIG. 3, magnets 130*a* and 130*b* (not shown) could be provided at each end of the flexible panel 106 to secure the flexible panel into an arcuate configuration. Each magnet 130 could mate with a corresponding component attached to the flexible panel 106, such as tab 131*a*, when the flexible panel 106 is configured in an arcuate configuration. Although not shown in FIG. 3, magnet 130*b* could be similarly disposed on the opposite end of the flexible panel 106, to mate with a corresponding component attached to the flexible panel 106, such as a tab 131*b*. Alternatively, magnets contained within the electro-acoustic transducers 104 could be used to secure the flexible panel. Other mechanisms could be used to secure the adjustment handles 118*a*, 118*b* into a position. For example, a series of grooves or other mechanical stop points could be provided within the housing 102 to mate with a corresponding boss or shoulder provided on each of the adjustment handles 118*a*, 118*b*. Any number of grooves or stop points could be provided, each corresponding to a different angle to which the flexible panel 106 can be adjusted. For example, three grooves or stop points could be provided at 5, 10 and 15 degrees, so that the top and bottom of the flexible panel 106 could be positioned at 5, 10 or 15 degrees from an axis 126 corresponding to the acoustic centers of the drivers 104 when positioned in a substantially straight configuration. The stop points could include, but are not limited to, one or more slots, detents, fasteners, screws, clamps, clasps, pins, clips or rivets.

In some examples, one or more mechanically adjustable points are provided along the interior of flexible panel 106 in between the ends of the flexible panel, while the ends of the flexible panel 106 are fixed. For example, an adjustment handle may be positioned substantially at the center of the flexible panel 106 to enable articulation of the flexible panel 106, and electro-acoustic drivers 104 into a C-shaped configuration. Other adjustment handles may be provided at other locations in between the center and the ends of the flexible panel to enable articulation of the flexible panel 106 and electro-acoustic drivers 104 into a J-shaped, reverse J-shaped configuration, or S-shaped configuration. Other mechanisms could be used to adjust the flexible panel at each adjustment point along the interior of the flexible panel, including but not limited to a fastener (e.g., a screw, clamp, clasp, clip, pin or rivet) and an adjustment rod.

Figure 4A:
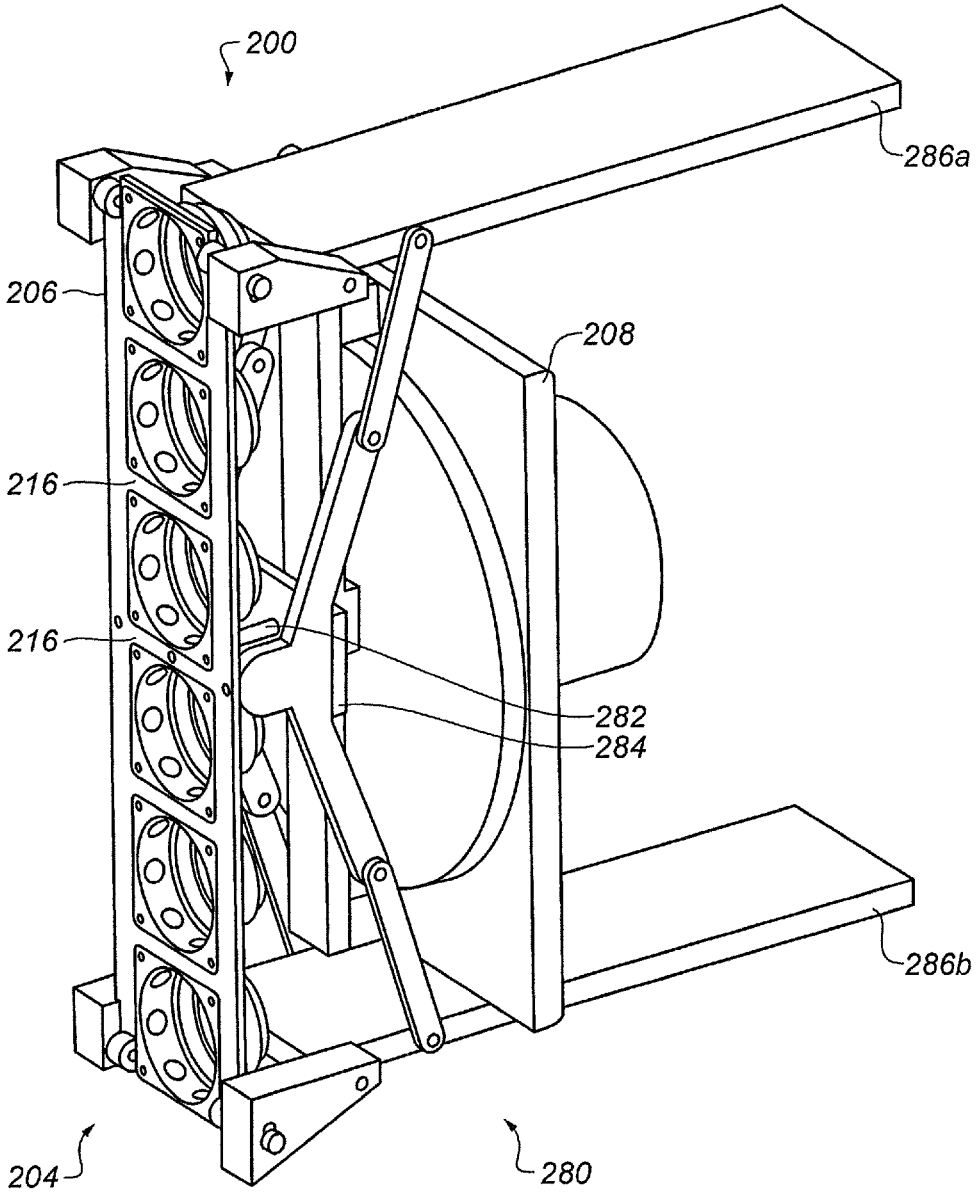
FIGS. 4A and 4B are perspective views of another example of an adjustable line array loudspeaker.
Figure 4B:
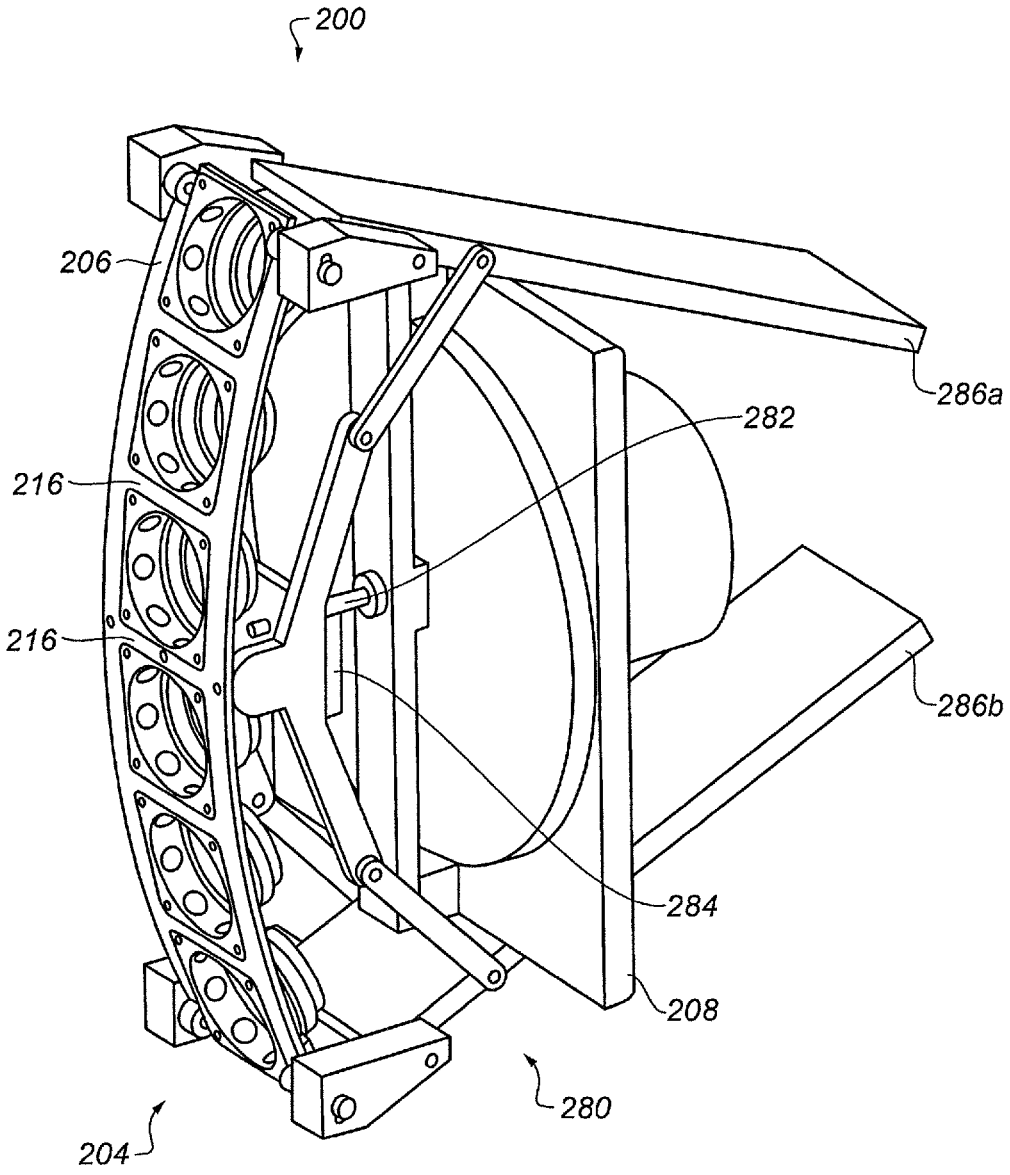

For example, referring to FIGS. 4A and 4B, a line array loudspeaker 200 includes a plurality of electro-acoustic drivers 204 coupled to a flexible panel 206, which is coupled to a mounting bracket 208. For ease of reference, like reference numbers indicate like features throughout the referenced drawings. The electro-acoustic drivers 204 may be joined by flexible joints 216 (two of which are referenced in FIGS. 4A and 4B) in the flexible panel 206, which enable curving of the flexible panel 206 into a number of configurations, as described herein. The loudspeaker 200 may also include an adjustment assembly 280, including an adjustment screw 282, adjustment plate 284, and adjustment paddles 286*a*, 286*b*. The flexible panel 206 and electro-acoustic drivers 204 can be positioned via the adjustment assembly 280 to be in a substantially straight configuration (as shown in FIG. 4A) or in an arcuate configuration (as shown in FIG. 4B).

In operation, the adjustment screw 282 may be rotated in one direction to curve the flexible panel 206 and rotated in the opposite direction to straighten the flexible panel 206. For example, as shown in FIG. 4B, the adjustment screw 282 has been rotated to move adjustment plate 284 away from the mounting bracket 208, thereby applying a force to the center of the flexible panel 206, which results in curvature of the panel. In FIG. 4A, the adjustment screw 282 has been rotated in the opposite direction to move adjustment plate 284 towards the mounting bracket 208, thereby releasing the force on the center of the flexible panel 206, resulting in a straight configuration. The adjustment screw 282 could be rotated varying amounts to achieve a desired curvature, and the overall curvature applied to the line array could range from −45 degrees to 45 degrees. The adjustment assembly 280 also may include adjustment paddles 286*a*, 286*b* that are moved in conjunction with the curving of the flexible panel 206. For example, if the adjustment screw 282 is rotated to apply a 20 degree curvature to the flexible panel, that same 20 degree curvature would be simultaneously applied to the adjustment paddles 286*a*, 286*b*. The adjustment paddles 286*a*, 286*b* could coincide with or be built into an enclosure (not shown) to mate with adjacent loudspeaker modules when multiple loudspeaker modules 200 are stacked on top of each other. Accordingly, the curvature applied to the adjustment paddles 286*a*, 286*b* via the adjustment screw 282 serves to adjust the angle between adjacent loudspeaker modules. Although not shown in FIGS. 4A and 3B, the loudspeaker 200 could be combined with other features from FIGS. 1 through 3, including a sectional horn assembly.

Figure 5:
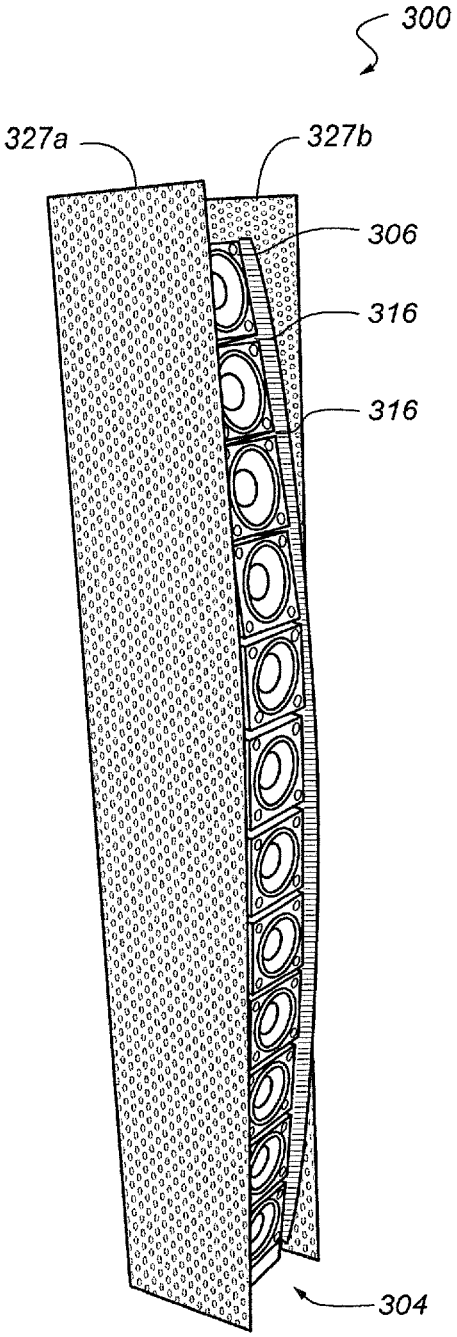
FIG. 5 is a perspective view of another example of an adjustable line array loudspeaker.

FIG. 5 shows another example of a line array loudspeaker 300 having a plurality of electro-acoustic drivers 304 coupled to a flexible panel 306. As in FIGS. 1 through 4, the electro-acoustic drivers 304 may be joined by flexible joints 316 (two of which are referenced in FIG. 5) in the flexible panel 306, which enable curving of the flexible panel 306 into a number of configurations, as described herein. The flexible panel 306 could be moved by, for example, adjustment handles, fasteners (e.g., screws, clamps, clasps, clips, pins or rivets), or an adjustment rod positioned at opposite ends of the flexible panel 306 or along the interior of the flexible panel 306. The line array loudspeaker 300 of FIG. 5 does not include a sectional horn assembly, but instead includes side panels 327*a*, 327*b* comprising an acoustically transparent material such as cloth or mesh. In operation, the side panels 327*a*, 327*b* permit additional sound waves generated by the electro-acoustic drivers 304 to be transmitted to the external environment when the line array is in an arcuate configuration. Although not shown in FIG. 5, the loudspeaker 300 could be combined with other features from FIGS. 1 through 4, including a sectional horn assembly.

Figure 7:
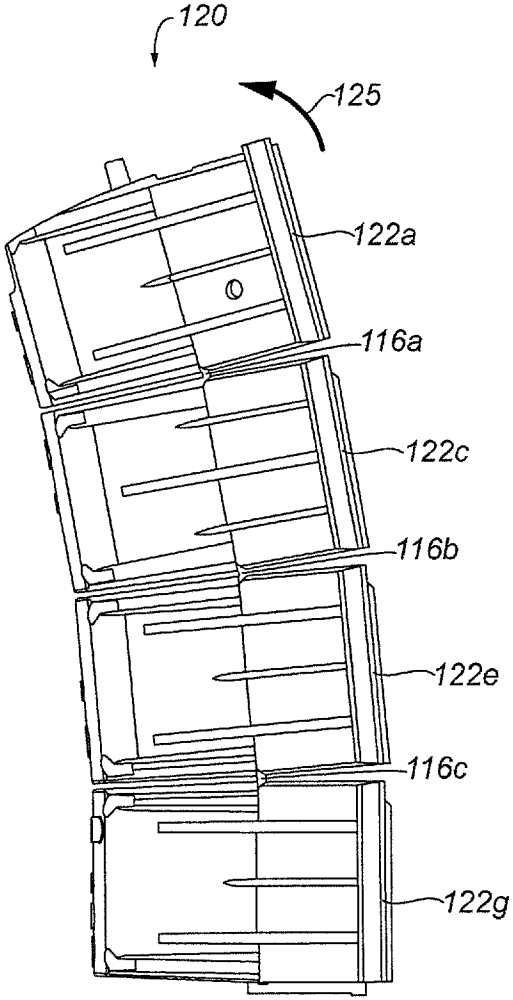
FIG. 7 is a side view of the sectional horn of FIG. 5.
Figure 6:
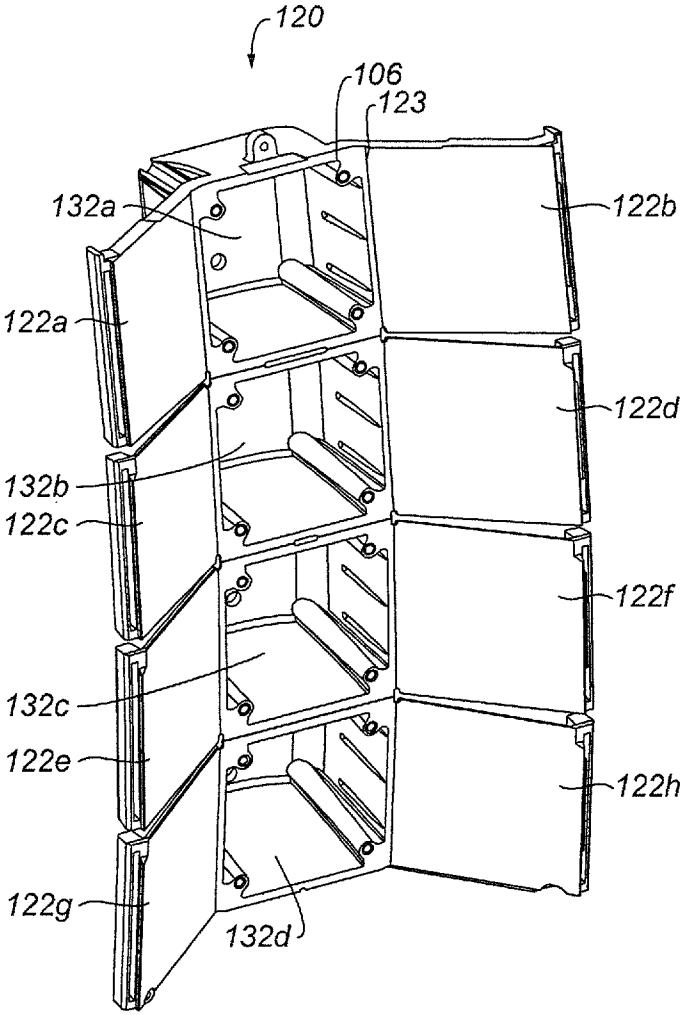
FIG. 6 is a perspective view of a sectional horn for use in the adjustable line array loudspeaker of FIG. 1.

Referring to FIGS. 6 and 7, the flexible panel 106 and sectional horn assembly 120 of FIG. 1 will be discussed further. The flexible panel 106 may include a plurality of driver base sections 132*a*-132*d*, which house the electro-acoustic drivers 104 (not shown). The electro-acoustic drivers 104 may be secured to the driver base sections 132 via screws or any other suitable method. Although four driver base sections 132*a*-132*d* are shown in FIGS. 6 and 7, any number of driver base sections could be used, depending on the number of electro-acoustic drivers 104 in the line array loudspeaker 100.

Figure 8B:
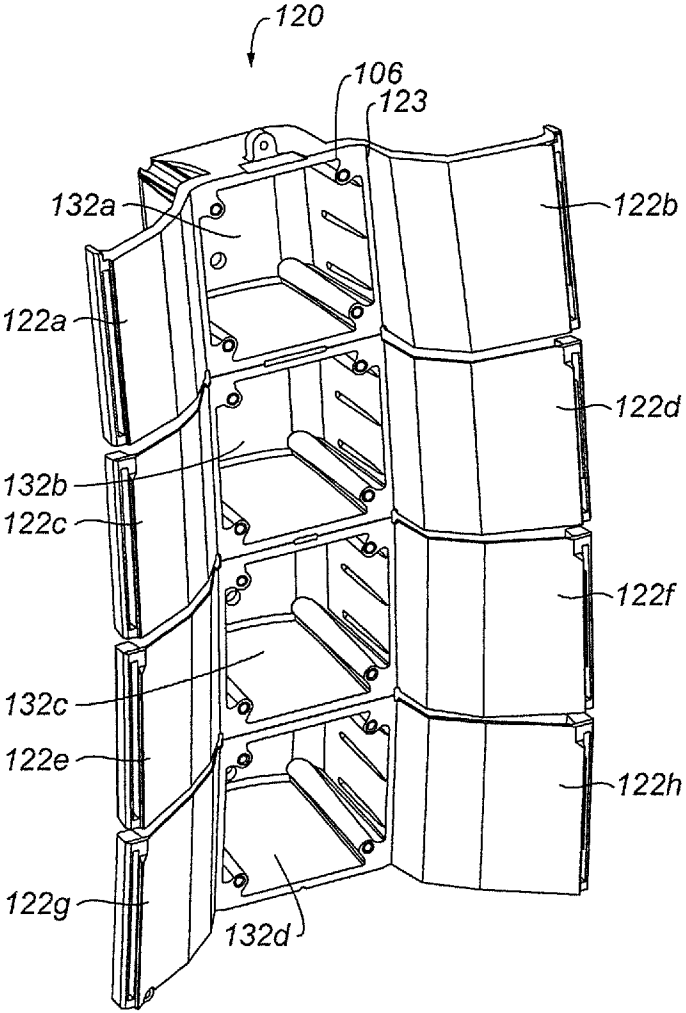
FIG. 8B is a perspective view of another example of a sectional horn for use in the adjustable line array loudspeaker of FIG. 1.
Figure 8A:
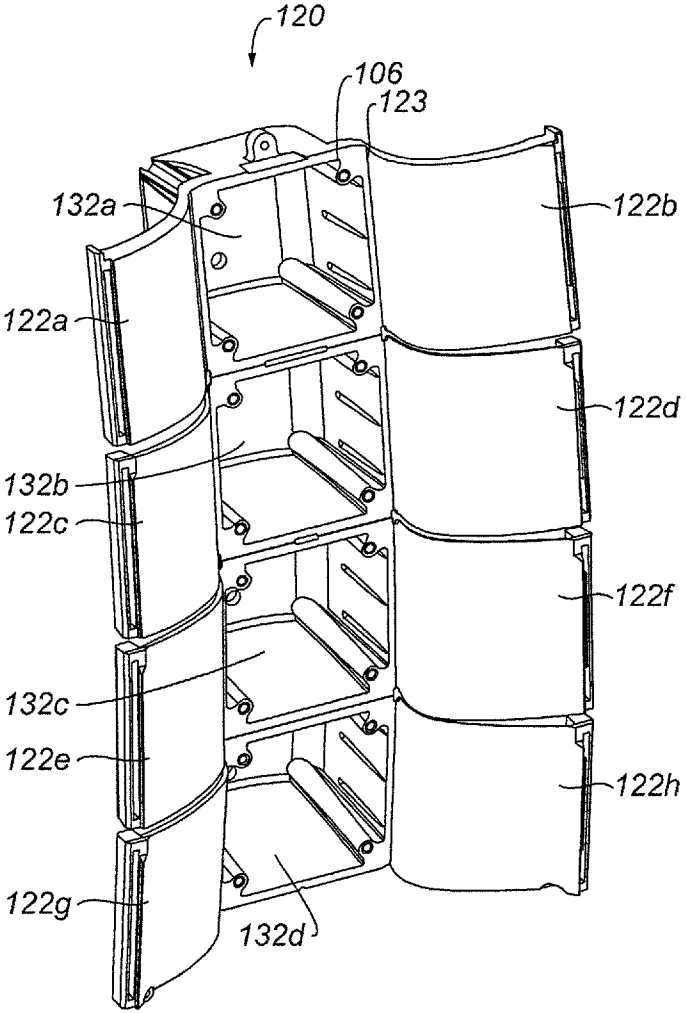
FIG. 8A is a perspective view of another example of a sectional horn for use in the adjustable line array loudspeaker of FIG. 1.

As shown in FIG. 6, in some examples, a plurality of horn walls 122*a*-122*h* are mechanically and/or acoustically coupled to the electro-acoustic drivers 104 and/or flexible panel 106. Although eight horn walls 122 are shown in FIG. 6 (two horn walls for each acoustic driver 104), any number of horn walls could be used. The horn walls 122*a*-122*h* may be secured to a front plane of the flexible panel, such that the electro-acoustic drivers 104 are acoustically coupled to the horn walls 122. The horn walls 122 may be substantially straight when viewed from the top (as shown in FIGS. 6 and 7), or may be curved or segmented (as shown in FIGS. 8A and 8B, respectively). The curved or segmented horn walls may be concave or convex when viewed from the front of the loudspeaker. In operation, the horn walls 122 conduct sound waves to the external environment and control the horizontal dispersion of the sound waves. Each horn wall 122 may be separated from adjacent horn walls by a gap, which enables the sectional horn assembly 120 to be curved in conjunction with the flexible panel 106 and, therefore, the electro-acoustic drivers 104. The horn walls 122 could be coupled to the flexible panel 106 via a living hinge. For example, as shown in FIG. 6, horn wall 122*b* could be connected to the flexible panel 106 via a flexible joint 123. Accordingly, the angle of the horn walls 122 could be adjusted to multiple positions depending on the desired horizontal coverage of the line array loudspeaker.

The flexible panel 106 and sectional horn assembly 120 may be manufactured as a single-piece injection molded part. In other words, the flexible panel 106 with its flexible joints 116 may be formed integrally with the horn walls 122 and driver base sections 132. The sectional horn assembly 120 may be made, for example, from a polymeric material, including but not limited to polypropylene, or any other suitable material. As such, the flexible joints 116 function as a living hinge, being made from the same material as the two pieces they connect. In other examples, the flexible joints 116 could be made from a flexible substance of a different material than the driver base sections 132 and/or horn walls 122.

FIG. 7 shows a side view of the sectional horn assembly 120 when the top of the flexible panel 106 has been moved away from the front plane of the line array loudspeaker 100, in a direction indicated by the arrow 125 in FIG. 6. When the flexible panel 106 is moved in this manner, the flexible panel 106, electro-acoustic drivers 104, and horn walls 122 together curve to create a reverse J-shape. More specifically, moving the flexible panel 106 causes the semi-flexible joints 116*a*-116*c* to flex or bend, thereby curving the sectional horn assembly 120.

Each acoustic driver 104 may be mechanically and/or acoustically coupled to two horn walls 122 that are positioned on each side of the acoustic driver. Alternatively, two or more electro-acoustic drivers may be mechanically and/or acoustically coupled to a pair of corresponding horn walls 122. In this case, each horn wall 122 may be separated from adjacent horn walls by a gap, and the groups of two or more electro-acoustic drivers 104 may be separated by flexible joints 116 in the flexible panel 106.

In some examples, the line array loudspeaker 100 may include more than one sectional horn assembly 120, each having a corresponding flexible panel 106 and electro-acoustic drivers 104. Each sectional horn assembly 120 may be disposed within the housing 102 and positioned in a manner that extends the line array loudspeaker 100 so that the height of the loudspeaker increases while the width of the loudspeaker remains substantially the same. For example, referring to FIG. 1, the line array loudspeaker 100 could include a single sectional horn assembly 120 housing eight electro-acoustic drivers, or two sectional horn assemblies stacked on top of each other, each housing four electro-acoustic drivers.

Figure 9:
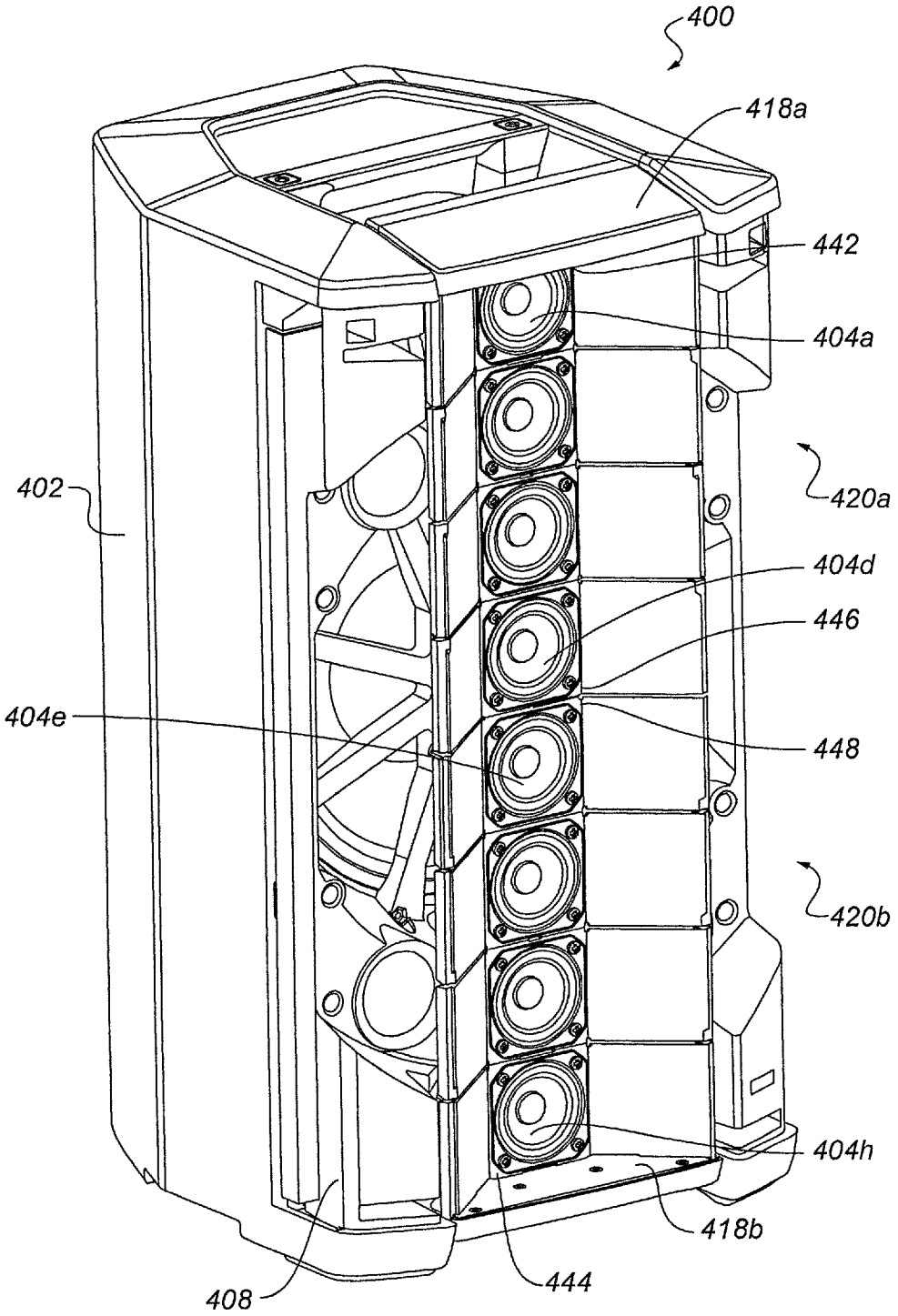
FIG. 9 is a perspective view of another example of an adjustable line array loudspeaker.

Referring to FIG. 9, a line array loudspeaker 400 is shown having two sectional horn assemblies 420*a*, 420*b* stacked on top of each other within a housing 402, each sectional horn assembly 420*a*, 420*b* housing four electro-acoustic drivers 404*a*-404*d* and 404*e*-404*h*. As shown in FIG. 9, a distal end 442, 444 of each sectional horn assembly 420*a*, 420*b* may be coupled to adjustment handles 418*a*, 418*b*, respectively, enabling articulation of each distal end 442, 444 to produce a straight or arcuate configuration. The central ends 446, 448 of each sectional horn assembly 420*a*, 420*b* may be secured to a mounting bracket 408, such that the central portion of the combined sectional horn assemblies 420*a*, 420*b* remains straight, even when the distal ends 442, 444 of the sectional horn assemblies 420*a*, 420*b* are positioned in an arcuate configuration. Thus, the sectional horn assemblies 420*a*, 420*b* can be positioned to together form a substantially straight configuration, a J-shaped configuration, a reverse J-shaped configuration, a C-shaped configuration, or an S-shaped configuration.

Figure 10:
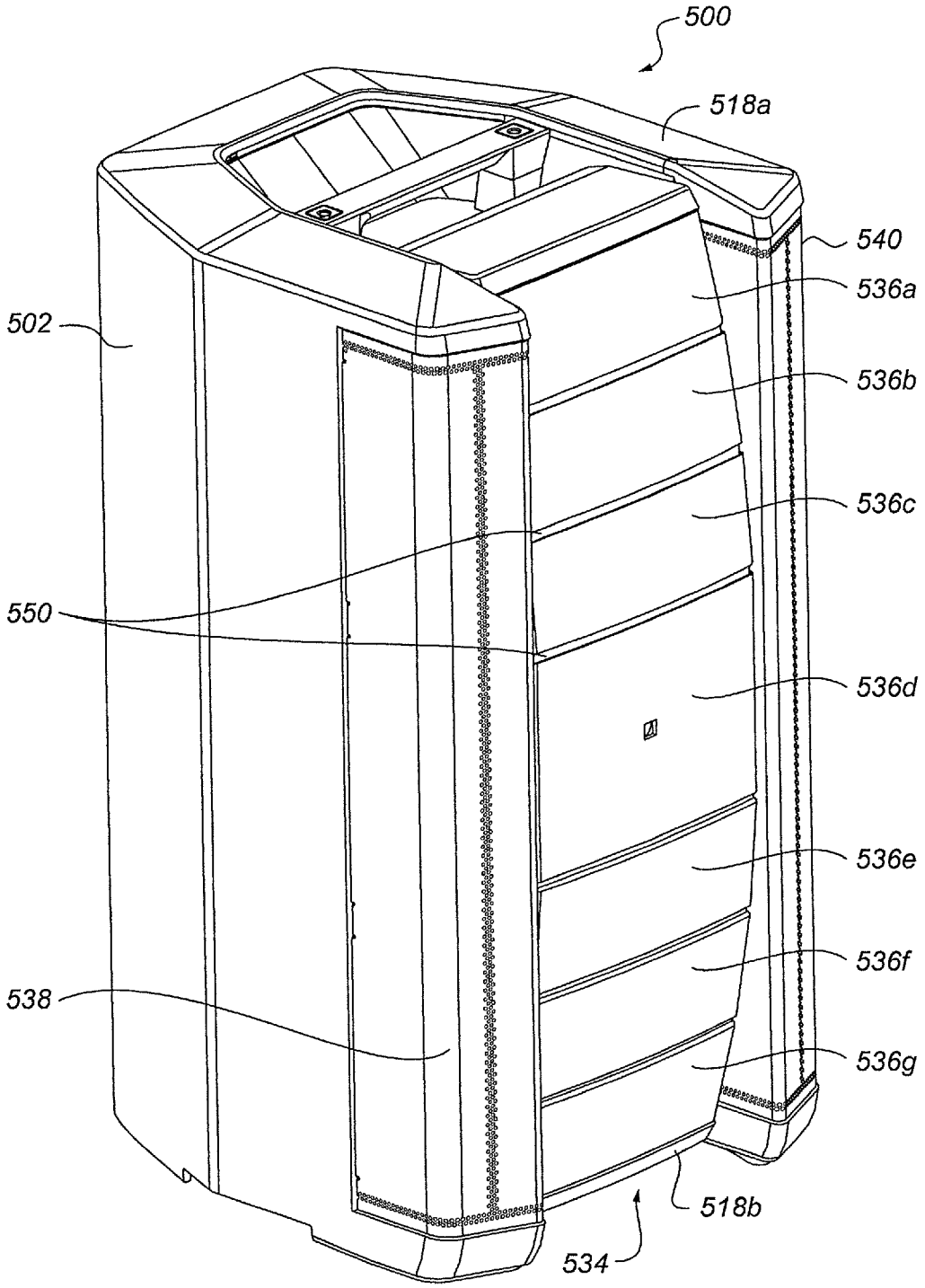
FIG. 10 is a perspective view of the loudspeaker of FIG. 1, with a protective grille.

In some examples, as shown in FIG. 10, a grille 534 (also referred to as a protective screen) may be provided in front of the electro-acoustic drivers 504 (not shown) to protect the electro-acoustic drivers. The grille 534 may include a plurality of grille panels 536*a*-536*g*, which may be perforated or comprise mesh, cloth, or any other acoustically transparent material. The grille panels 536*a*-536*g* are disposed in front of the electro-acoustic drivers 504 in a manner that enables the grille panels 536 to curve in conjunction with the flexible panel 506 (not shown in FIG. 10) and electro-acoustic drivers 504. For example, each grille panel 536 may be joined to an adjacent grill panel 536 via a flexible joint 550 (two of which are referenced in FIG. 10). When an adjustment handle 518*a* and/or 518*b* is moved to adjust the configuration of the line array loudspeaker 500 to, for example, a substantially straight, J-shaped, reverse J-shaped, C-shaped, or S-shaped configuration, some or all of the flexible joints 550 between the grille panels 536 flex or bend, causing the grille 536 to curve in conjunction with the line array. The curving of the grille 534 thus provides a visual indicator of the position and curvature of the electro-acoustic drivers 404. As with the flexible panel, the flexible joints 550 may be made of the same material as the grille panels 536, and thus may function as a living hinge. In other examples, the flexible joints 550 could be made from a flexible substance of a different material than the grille panels 550.

Although seven grille panels are shown in FIG. 10, any number of grille panels could be used. In the example shown in FIG. 10, the central grill panel (536*d*) is configured to cover two electro-acoustic drivers, and may be secured so that it does not bend or curve when the line array is in an arcuate configuration. In other examples, however, the central grille panel (536*d*) could comprise two or more panels and could be configured to curve with the line array. The grille panels 536 may have substantially the same shape and dimensions, or they may be different. The housing 502 may be closed on the sides of the grille 534 with side caps 538 and 540. Each side cap may function to seal the acoustic enclosure by known methods, for example, by compression of a gasketing material.

Figure 11:
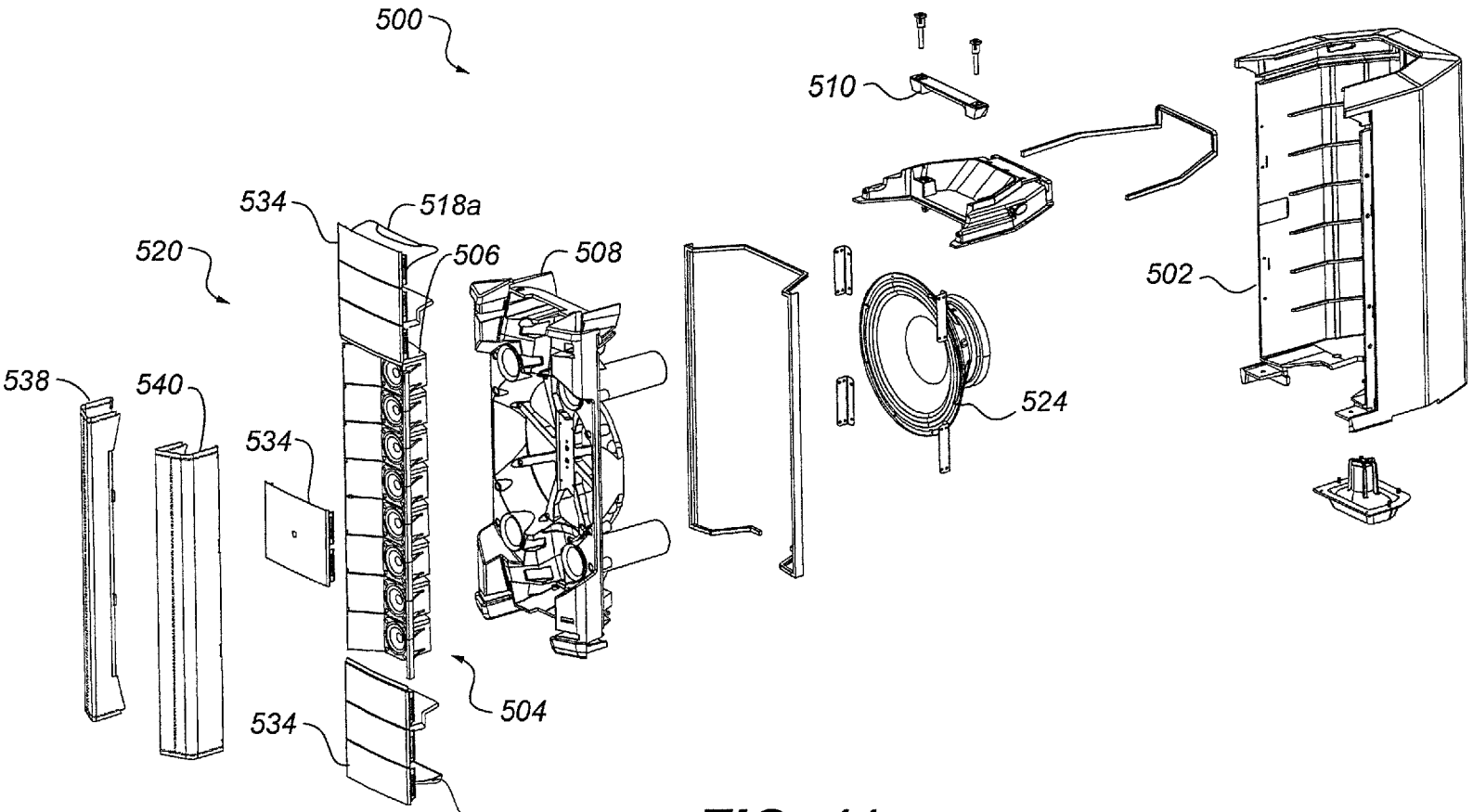
FIG. 11 is an exploded view of the loudspeaker of FIG. 9.

FIG. 11 shows an exploded view of one example of the line array loudspeaker 500 of FIG. 10, including a housing 502 and a plurality of electro-acoustic drivers 504 mounted on a flexible panel 506 that is held in place within the housing by a mounting bracket 508. The flexible panel 506 is coupled to a sectional horn assembly 520. The positions of the flexible panel 506 and sectional horn assembly 520 can be adjusted via adjustment handles 518*a*, 518*b*. A grille 534 covers the electro-acoustic drivers 504 and is held in place via side caps 538, 540. The line array loudspeaker 500 also includes a low frequency driver 524 and a handle 510 to permit carrying during transport. In operation, when a user adjusts the position of the line array via the adjustment handles 518*a*, 518*b*, the flexible panel 506, sectional horn assembly 520, electro-acoustic drivers 504 and grille 534 together curve in a manner that corresponds to the movement of the adjustment handles 518*a*, 518*b*. Thus, the line array loudspeaker 500 can be configured in any number of configurations, including a substantially straight and arcuate configuration.

Figure 12:
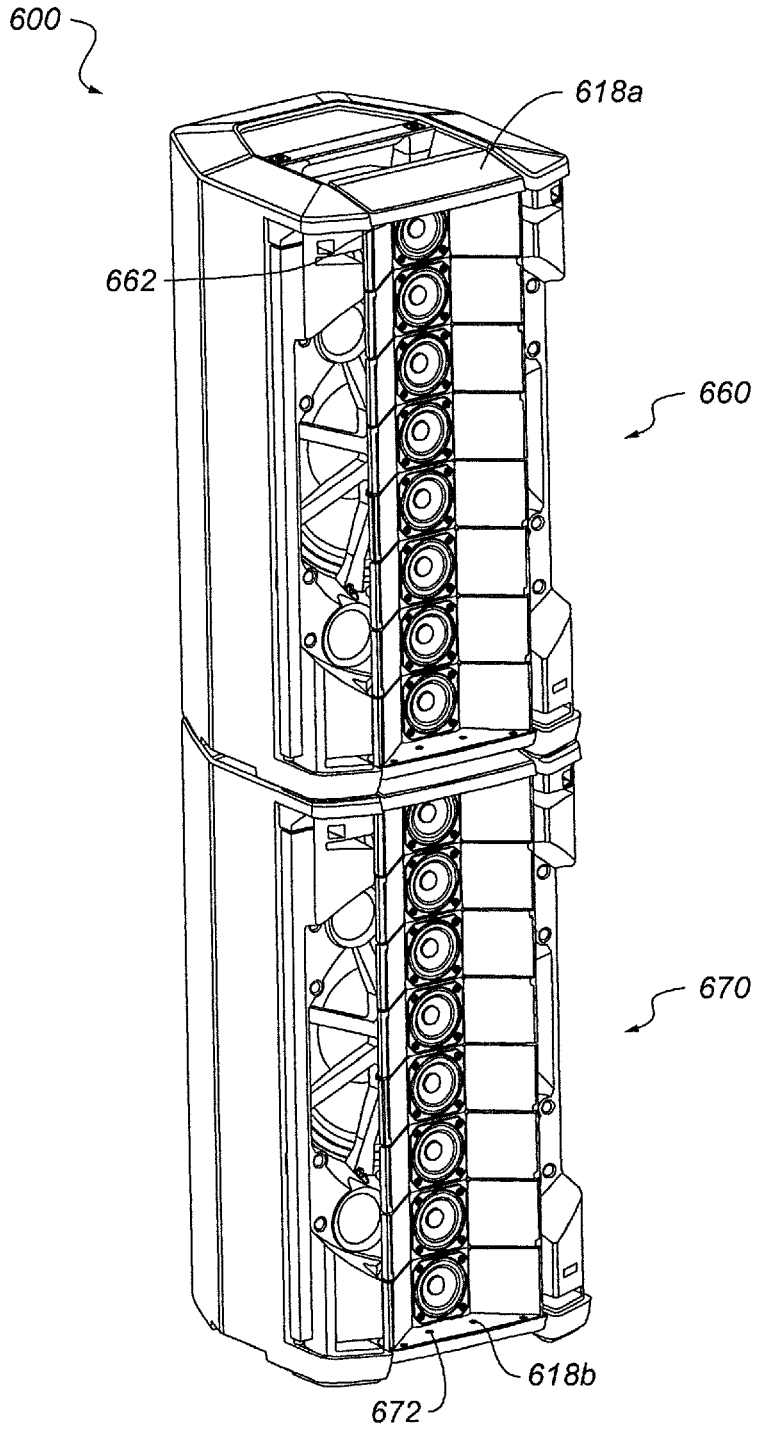
FIG. 12 is a perspective view of an adjustable line array loudspeaker with multiple line array loudspeaker modules.

In the various examples of the line array loudspeaker discussed with reference to FIGS. 1 through 11, the loudspeaker can be lengthened by providing multiple line array loudspeaker modules that can be attached to create a longer line array loudspeaker. Stacking multiple loudspeaker modules permits adjustability of the sound power level output by the loudspeaker while at the same time independently allowing the shape of the loudspeaker to be adjusted for the purpose of optimizing sound coverage of an audience area. For example, with fewer loudspeaker modules, a lower sound power level can be achieved, whereas with multiple loudspeaker modules, a higher sound power level can be achieved. Thus, the sound power level can be tailored to particular venues and applications. Referring to FIG. 12, two line array loudspeaker modules 660 and 670 are stacked on top of each other in a manner that extends the line array loudspeaker 600 so that the height of the loudspeaker increases while the width of the loudspeaker remains substantially the same. Although two loudspeaker modules 660, 670 are shown in FIG. 12, any number of loudspeaker modules could be stacked to create a longer line array loudspeaker. The loudspeaker modules 660 and 670 can be attached to each other in any suitable manner, for example via a channel and flange. Additional line array module loudspeakers may be attached to the end in a similar way to create a line array loudspeaker several modules in length. As shown in FIG. 12, a distal end 662, 672 of each loudspeaker module 660, 670 may be coupled to adjustment handles 618*a* and 618*b*, respectively, enabling articulation of each distal end 662, 672 to produce a straight or arcuate configuration. Thus, the loudspeaker modules 660, 670 can be adjusted to together form a substantially straight, J-shaped, reverse J-shaped, C-shaped, or S-shaped configuration. Each loudspeaker module could be adjusted to the same configuration, or each loudspeaker module could be adjusted to a different configuration, with different corresponding coverage angles.

In the various examples of the line array loudspeaker described herein, the loudspeaker may be configured to determine that the line array is in a particular configuration. For example, the line array loudspeaker may include one or more position sensors coupled to opposite ends of the line array for detecting that the position of the line array has changed. The position sensors could comprise any suitable sensor, including but not limited to a magnetic sensor, infrared sensor, photoelectric sensor, capacitive sensor, inductive sensor, Reed sensor, Hall effect sensor, contact switch, or any combination thereof. When the position of the line array changes from, for example, a substantially straight configuration to an arcuate configuration, the position sensors detect the change, and send a signal to a processor within the loudspeaker to communicate the new configuration of the line array. One such system for detecting the position of the line array loudspeaker is described in U.S. patent application Ser. No. 14/246,686, titled "Automatic Equalization of Loudspeaker Array" filed on Apr. 7, 2014, the entire contents of which are incorporated here by reference.

Figure 13:
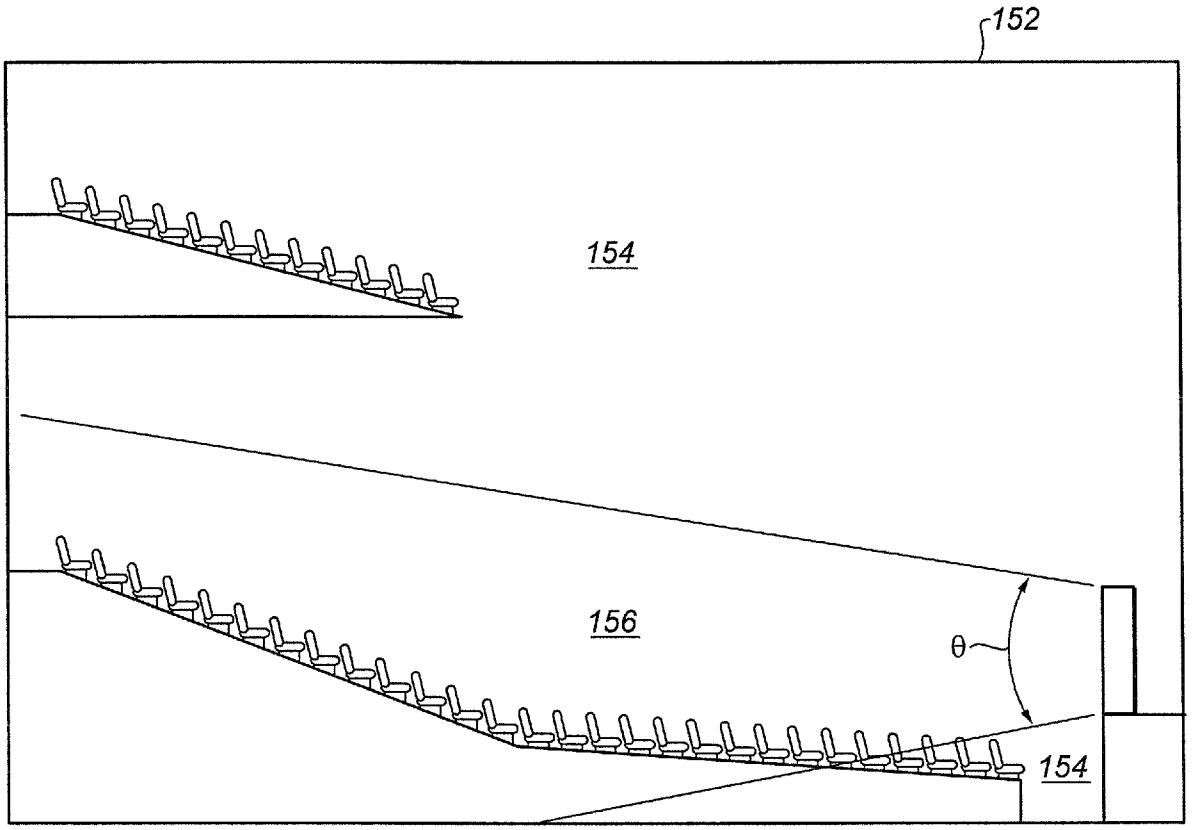
FIG. 13 is a side elevation view of a line array loudspeaker in a venue.
Figure 14:
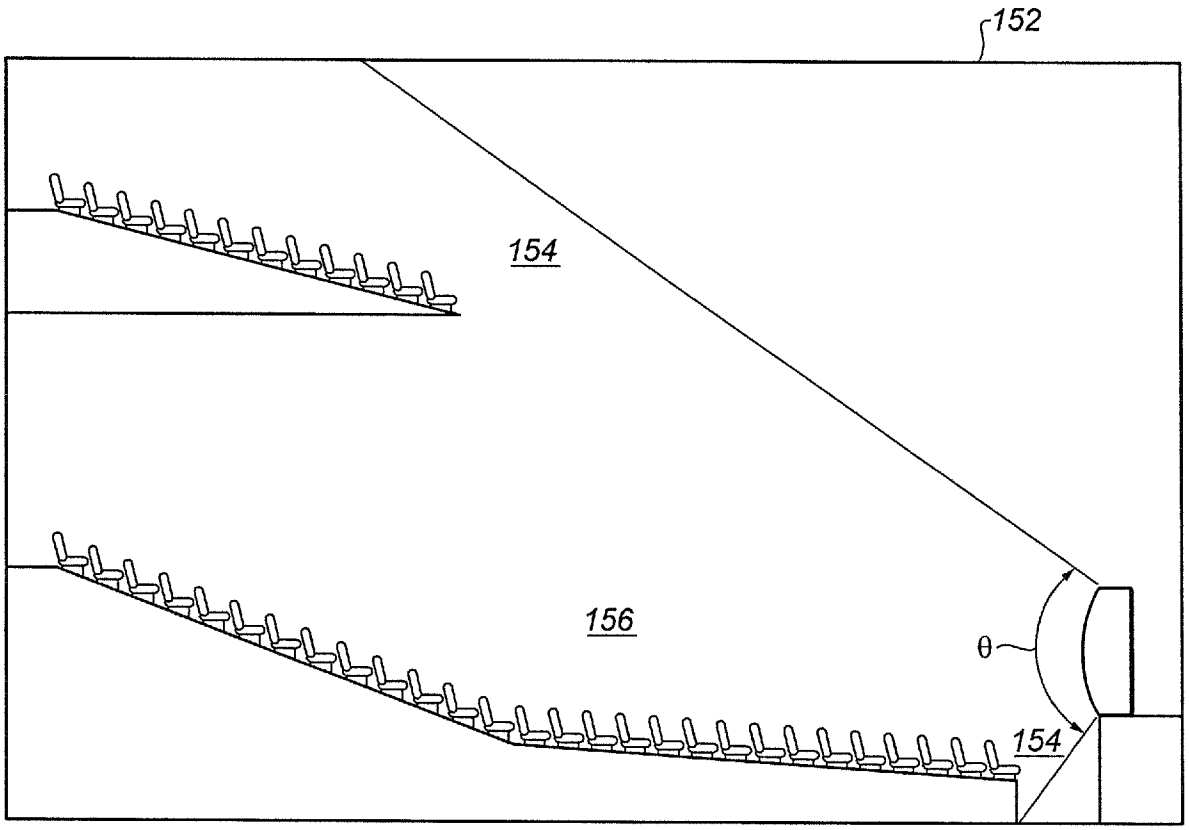
FIG. 14 is a side elevation view of an adjustable line array loudspeaker in a venue.

Typical line array loudspeakers tend to have tight vertical dispersion, so that the SPL above the top of the loudspeaker is significantly less than the SPL below the top of the loudspeaker. Thus, as shown in FIG. 13, with a typical line array loudspeaker, particularly in a venue 152 having raked seating in which the audience is situated on multiple horizontal planes, some portions 154 of the audience may be outside the vertical dispersion angle θ of the loudspeaker. As such, those portions 154 of the audience may receive significantly less high frequency radiation than other portions 156 of the audience. With the adjustable line array loudspeaker discussed herein, the vertical dispersion pattern can be adjusted to meet the needs of a particular venue, even one in which the audience is situated on multiple horizontal planes. For example, as shown in FIG. 14 (which has the same venue 152 and audience as in FIG. 13), the line array loudspeaker can be adjusted to increase the vertical dispersion pattern on both ends of the loudspeaker, so that the portions 154 of the audience receive similar levels of high frequency radiation as other portions 156 of the audience. Thus, as compared with conventional line array loudspeakers, the line array loudspeaker described herein has greater flexibility and can be tailored to particular venues and applications to deliver an adjustable coverage pattern that reaches larger portions of an audience.

The various examples of the adjustable line array loudspeaker discussed herein may be used in installed or portable sound systems, for example, in schools, auditoria, houses of worship, meeting rooms, or live performance venues. For example, the adjustable line array loudspeaker could be used in a loudspeaker utilizing compression drivers coupled to a sectional horn assembly via an adaptor, such as the manifold components described in U.S. patent application Ser. No. 12/557,885, titled "Automated Customization of Loudspeakers" filed on Sep. 11, 2009, the entire contents of which are incorporated here by reference. The adjustable line array loudspeaker may be oriented vertically or non-vertically, for example non-perpendicular to the floor or horizontally. The adjustable line array loudspeaker could be wall-mounted or freestanding.

A number of implementations have been described. Nevertheless, it will be understood that additional modifications may be made without departing from the scope of the inventive concepts described herein, and, accordingly, other embodiments are within the scope of the following claims.

What is claimed is:

1. A line array loudspeaker comprising:

a first plurality of flexible joints;

a first plurality of electro-acoustic drivers being linked to each other by the first plurality of flexible joints;

a protective grille positioned in front of the first plurality of electro-acoustic drivers; and a first sectional horn assembly coupled to the first plurality of electro-acoustic drivers, wherein the first plurality of electro-acoustic drivers is adjustable so that it can be positioned such that an axis that runs through an acoustic center of the first plurality of electro-acoustic drivers is articulable to produce three or more configurations including: a substantially straight configuration and a plurality of arcuate configurations, and wherein the protective grille is flexible, such that it curves in conjunction with the first plurality of electro-acoustic drivers when positioned in one of the plurality of arcuate configurations.

2. The line array loudspeaker of claim 1 wherein the plurality of arcuate configurations includes a J-shaped configuration, a reverse J-shaped configuration, and a C-shaped configuration.

3. The line array loudspeaker of claim 1 wherein the first sectional horn assembly is flexible, such that it curves in conjunction with the first plurality of electro-acoustic drivers when positioned in one of the plurality arcuate configurations.

4. The line array loudspeaker of claim 3 wherein the first sectional horn assembly and first plurality of flexible joints are produced as a single-piece injected molded part.

5. The line array loudspeaker of claim 1 further comprising:

a second plurality of flexible joints;

a second plurality of electro-acoustic drivers being linked to each other by the second plurality of flexible joints; and a second sectional horn assembly coupled to the second plurality electro-acoustic drivers, wherein the second plurality of electro-acoustic drivers is positioned in a manner that extends the first plurality of electro-acoustic drivers, so that the height of the line array loudspeaker is increased and the width of the line array loudspeaker remains substantially the same.

6. The line array loudspeaker of claim 5 wherein the first and second pluralities of electro-acoustic drivers are adjustable so that they together form one of: a substantially straight line, a J-shape, a reverse J-shape, and a C-shape.

7. The line array loudspeaker of claim 1 further comprising a handle configured to enable manual adjustment of the first plurality of electro-acoustic drivers.

8. The line array loudspeaker of claim 1 wherein one or more magnets secure the first plurality of electro-acoustic drivers into one of: a substantially straight line, J-shape, reverse J-shape, and C-shape.

9. The line array loudspeaker of claim 1 further comprising:

a second plurality of flexible hinges;

a second plurality of electro-acoustic drivers being linked to each other by the second plurality of flexible joints; and a second sectional horn assembly coupled to the second plurality of electro-acoustic drivers, wherein the second plurality of electro-acoustic drivers is configured to be positioned in a manner that extends the first plurality of electro-acoustic drivers, so that the height of the line array loudspeaker is increased and the width of the line array loudspeaker remains substantially the same, and wherein the first and second pluralities of electro-acoustic drivers are adjustable so that they together form one of: a substantially straight line, a J-shape, a reverse J-shape, and a C-shape.

10. A loudspeaker system comprising:

a first plurality of flexible joints;

a first line array of electro-acoustic drivers being linked to each other by the first plurality of flexible joints; and at least one mechanically adjustable point that enables articulation of the line array at the flexible joints to produce three or more configurations including a substantially straight configuration, and plurality of curved configurations of the first line array of electro-acoustic drivers, wherein the first line array of electro-acoustic drivers is coupled to a first sectional horn and a protective grille, each of the first sectional horn and the protective grille configured to curve in conjunction with the first line array of electro-acoustic drivers when positioned in one of the plurality of curved configurations.

11. The loudspeaker system of claim 10 wherein the first sectional horn and first plurality of flexible joints are produced as a single-piece injection molded part.

12. The loudspeaker system of claim 11 wherein the first sectional horn and first plurality of flexible joints comprise a flexible material.

13. The loudspeaker system of claim 10 wherein the first line array of electro-acoustic drivers is disposed in a first housing.

14. The loudspeaker system of claim 13 further comprising:

a second plurality of flexible joints;

a second line array of electro-acoustic drivers being linked to each other by the second plurality of flexible joints; and at least one mechanically adjustable point that enables articulation of the second flexible panel at the second plurality of flexible joints, wherein the second line array of electro-acoustic drivers is disposed in the first housing and positioned in a manner that extends the first line array of electro-acoustic drivers, so that the height of the loudspeaker system is increased and the width of the loudspeaker system remains substantially the same.

15. The loudspeaker system of claim 14 wherein the first and second line arrays are adjustable so that the first and second line arrays of electro-acoustic drivers together form one of: a substantially straight line, a J-shape, a reverse J-shape, and a C-shape.

16. The loudspeaker system of claim 10 wherein the first line array of electro-acoustic drivers is positioned in front of a low frequency driver.

17. The loudspeaker system of claim 10 further comprising a handle coupled to the at least one mechanically adjustable point to enable manual adjustment of the first line array.

18. The loudspeaker system of claim 10 wherein one or more magnets secure the at least one mechanically adjustable point into the substantially straight configuration, and the plurality of curved configurations.

19. The loudspeaker system of claim 10 further comprising a protective grille positioned in front of the first line array of electro-acoustic drivers.

* * * * *